US007578705B2

(12) United States Patent
He et al.

(10) Patent No.: US 7,578,705 B2
(45) Date of Patent: Aug. 25, 2009

(54) ELECTRICAL CONNECTOR WITH IMPROVED CONTACTS ARRANGEMENT

(75) Inventors: Jia-Yong He, Kunshan (CN); Qi-Sheng Zheng, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/228,389

(22) Filed: Aug. 11, 2008

(65) Prior Publication Data

US 2009/0042451 A1 Feb. 12, 2009

(30) Foreign Application Priority Data

Aug. 10, 2007 (CN) ..... 2007 2 0042743 U
Aug. 10, 2007 (CN) ..... 2007 2 0042744 U

(51) Int. Cl.
*H01R 24/00* (2006.01)

(52) U.S. Cl. ..... 439/660

(58) Field of Classification Search ..... 439/660, 439/607, 540.1, 541.5, 219, 218
See application file for complete search history.

(56) References Cited

U.S. PATENT DOCUMENTS

| | | | | |
|---|---|---|---|---|
| 5,685,739 | A * | 11/1997 | Davis et al. | 439/607 |
| 6,062,892 | A * | 5/2000 | Meng et al. | 439/357 |
| 7,021,971 | B2 | 4/2006 | Chou et al. | |
| 7,104,848 | B1 | 9/2006 | Chou et al. | |
| 7,108,560 | B1 | 9/2006 | Chou et al. | |
| 7,125,287 | B1 * | 10/2006 | Chou et al. | 439/660 |
| 7,134,884 | B2 | 11/2006 | Wang et al. | |
| 2009/0042450 | A1 * | 2/2009 | Zheng et al. | 439/660 |

* cited by examiner

*Primary Examiner*—Phuong K Dinh
(74) *Attorney, Agent, or Firm*—Wei Te Chung

(57) ABSTRACT

An electrical connector (100) includes a first interface (10) having a first tongue plate (12) extending therein, a second interface (11) disposed on a side of the first interface, a first contact group (3) held in the first tongue plate, and a second contact group (4) extending into the second interface. The first contact group includes a set of first contacts (31) each having a first resilient contacting portion (33) and a set of second contacts (32) each having a second stiff contacting portion (36). The first contacting portion (33) and the second contacting portion (36) are essentially located on a same side of the first tongue plate (12).

2 Claims, 8 Drawing Sheets

ELECTRICAL CONNECTOR WITH IMPROVED CONTACTS ARRANGEMENT

BACKGROUND OF THE INVENTION

1. Field of the Invention

The present invention generally relates to an electrical connector and more particularly to an electrical connector adapted for mating with a standard Universal Serial Bus (USB) plug.

2. Description of Related Art

Personal computers (PC) are used in a variety of ways for providing input and output. Universal Serial Bus (USB) is a serial bus standard to the PC architecture with a focus on computer telephony interface, consumer and productivity applications. The design of USB is standardized by the USB Implementers Forum (USB-IF), an industry standard body incorporating leading companies from the computer and electronic industries. USB can connect peripherals such as mouse devices, keyboards, PDAs, gamepads and joysticks, scanners, digital cameras, printers, external storage, networking components, etc. For many devices such as scanners and digital cameras, USB has become the standard connection method.

As of 2006, the USB specification was at version 2.0 (with revisions). The USB 2.0 specification was released in April 2000 and was standardized by the USB-IF at the end of 2001. Previous notable releases of the specification were 0.9, 1.0, and 1.1. Equipment conforming to any version of the standard will also work with devices designed to any previous specification (known as: backward compatibility).

USB supports three data rates: 1) A Low Speed rate of up to 1.5 Mbit/s (187.5 KB/s) that is mostly used for Human Interface Devices (HID) such as keyboards, mice, and joysticks; 2) A Full Speed rate of up to 12 Mbit/s (1.5 MB/s); (Full Speed was the fastest rate before the USB 2.0 specification and many devices fall back to Full Speed. Full Speed devices divide the USB bandwidth between them in a first-come first-served basis and it is not uncommon to run out of bandwidth with several isochronous devices. All USB Hubs support Full Speed); 3) A Hi-Speed rate of up to 480 Mbit/s (60 MB/s). Though Hi-Speed devices are commonly referred to as "USB 2.0" and advertised as "up to 480 Mbit/s", not all USB 2.0 devices are Hi-Speed. Hi-Speed devices typically only operate at half of the full theoretical (60 MB/s) data throughput rate. Most Hi-Speed USB devices typically operate at much slower speeds, often about 3 MB/s overall, sometimes up to 10-20 MB/s. A data transmission rate at 20 MB/s is sufficient for some but not all applications. However, under a circumstance transmitting an audio or video file, which is always up to hundreds MB, even to 1 or 2 GB, currently transmission rate of USB is not sufficient. As a consequence, faster serial-bus interfaces are being introduced to address different requirements. PCI Express, at 2.5 GB/s, and SATA, at 1.5 GB/s and 3.0 GB/s, are two examples of High-Speed serial bus interfaces.

From an electrical standpoint, the higher data transfer rates of the non-USB protocols discussed above are highly desirable for certain applications. However, these non-USB protocols are not used as broadly as USB protocols. Many portable devices are equipped with USB connectors other than these non-USB connectors. One important reason is that these non-USB connectors contain a greater number of signal pins than an existing USB connector and are physically larger as well. For example, while the PCI Express is useful for its higher possible data rates, a 26-pin connectors and wider card-like form factor limit the use of Express Cards. For another example, SATA uses two connectors, one 7-pin connector for signals and another 15-pin connector for power. Due to its clumsiness, SATA is more useful for internal storage expansion than for external peripherals.

As discussed above, the existing standard USB connectors have a small size but low transmission rate, while other non-USB connectors (PCI Express, SATA, et al) have a high transmission rate but large size. Neither of them is desirable to implement modern high-speed, miniaturized electronic devices and peripherals. To provide a kind of connector with a small size and a high transmission rate for portability and high data transmitting efficiency is much desirable.

Hence, an improvement over the prior art is required to overcome the problems thereof.

SUMMARY OF THE INVENTION

According one aspect of the present invention, an electrical connector comprises a first interface having a first tongue plate extending therein, a second interface disposed on a side of the first interface, a first contact group held in the first tongue plate, and a second contact group extending into the second interface. The first contact group comprises a plurality of first contacts each having a first resilient contacting portion and a plurality of second contacts each having a second stiff contacting portion. The first contacting portion and the second contacting portion are essentially located on a same side of the first tongue plate.

According to another aspect of the present invention, an electrical connector comprises an insulative housing having a first interface and a second interface arranged side by side, a first contact group held in the insulative housing, and a second contact group held in the insulative housing and extending into the second interface. The first interface has a first tongue plate extending therein. The first contact group comprises a plurality of first contacts each having a first contacting portion and a plurality of second contacts each having a second contacting portion. The first contacting portions and the second contacting portions are essentially located on a same side of the first tongue plate and have a different height along a thickness direction of the first tongue plate.

These and additional objects, features, and advantages of the present invention will become apparent after reading the following detailed description of the preferred embodiment of the invention taken in conjunction with the appended drawings.

DETAILED DESCRIPTION OF THE INVENTION

Figure 1:
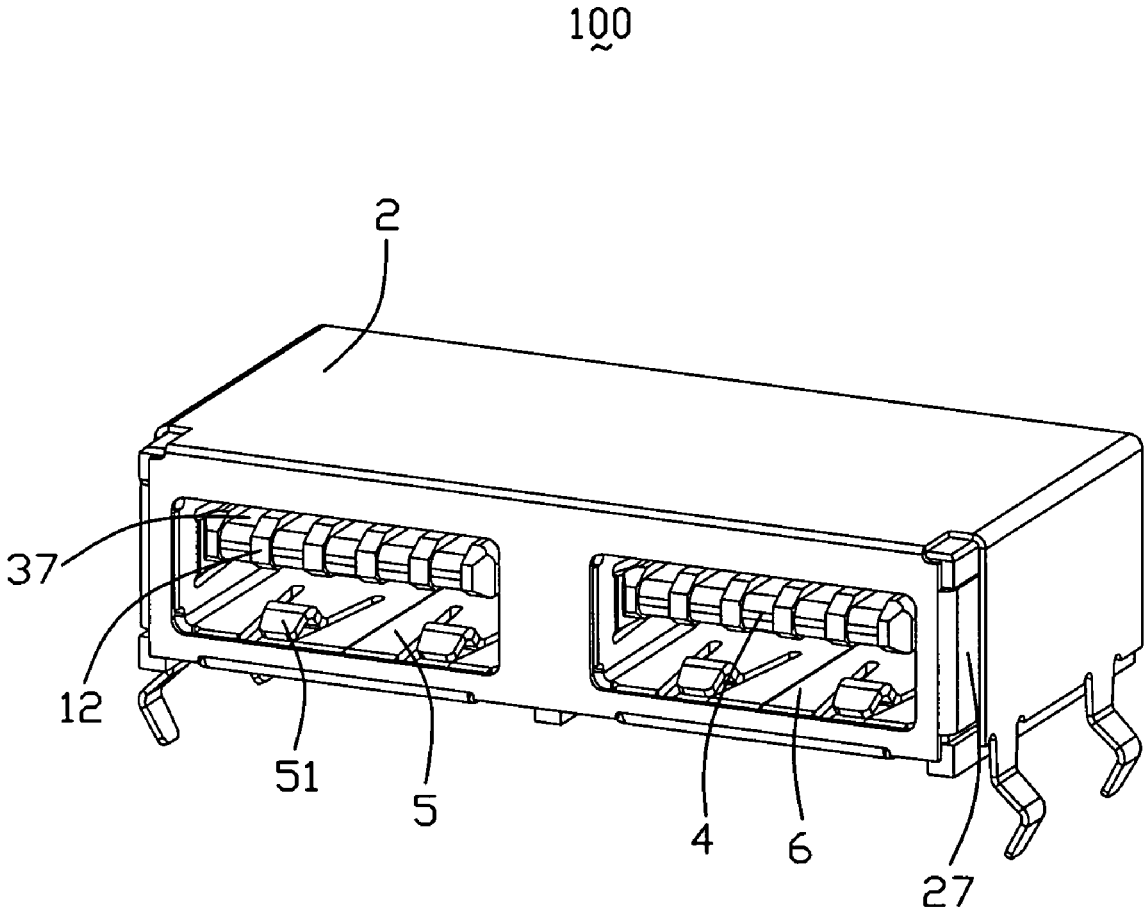
FIG. 1 is a perspective view of an electrical connector according to a first embodiment of the present invention.

Reference will now be made to the drawing figures to describe the preferred embodiment of the present invention in detail.

Figure 3:
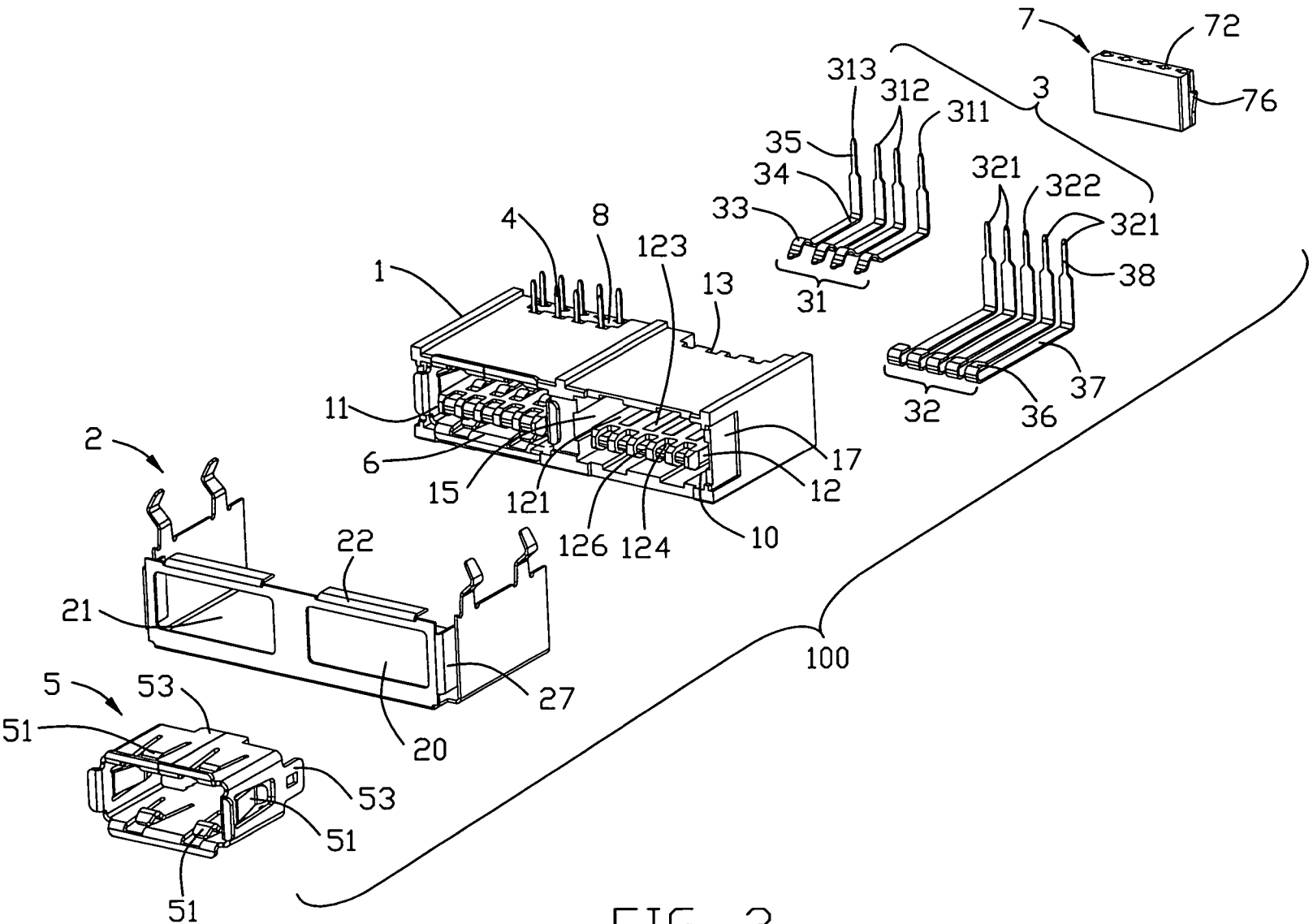
FIG. 3 is a partly exploded view of the electrical connector shown in FIG. 1.
Figure 4:
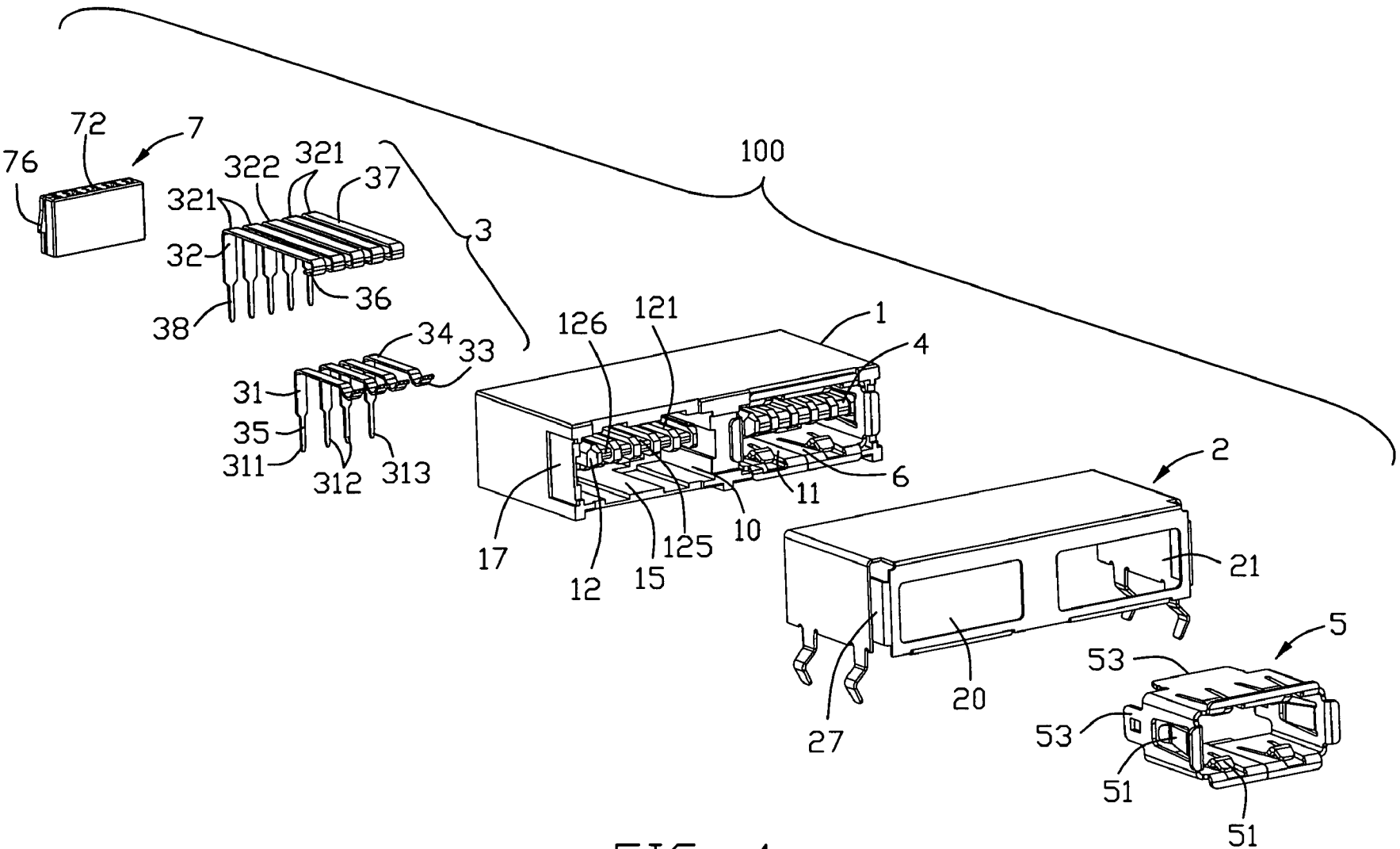
FIG. 4 is a view similar to FIG. 3, but taken from a second aspect.
Figure 5:
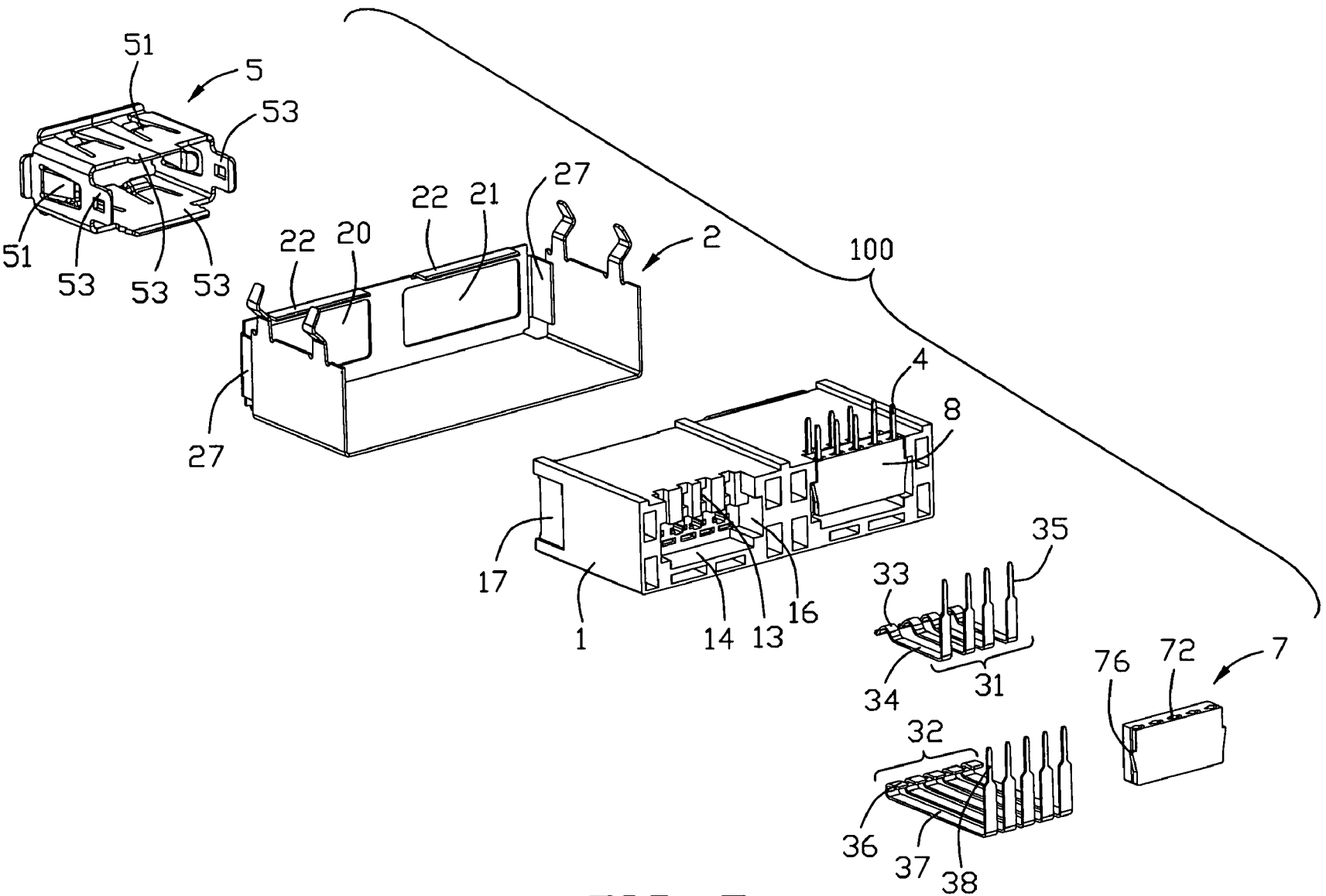
FIG. 5 is a view similar to FIG. 3, but taken from a third aspect.

Referring to FIGS. 3-5, an electrical connector 100 according to a first embodiment of the present invention, comprises an insulative housing 1, a first contact group 3 and a second contact group 4 held in the insulative housing 1, a first inner shell 5, a second inner shell 6, a first spacer 7 and a second spacer 8 assembled to the insulative housing 1, and an outer shell 2 enclosing the insulative housing 1.

Referring to FIG. 3-5, the insulative housing 1 integrally formed with a first interface 10 and a second interface 11 located at a lateral side of the first interface 10. The structure of the first interface 10 and the second interface 11 are the same, so now taking the first interface 10 for example. The first interface 10 comprises a receiving chamber 15 and a first tongue plate 12 extending therein for supporting the first contact group 3. The first tongue plate 12 forms an upper side 122 and a lower side 121 opposite to the upper side 122. A plurality of first grooves 123 arranged in one row and a plurality of second grooves 124 arranged in another row behind the first grooves 123 are located on the lower side 121. A plurality of third grooves 125 arranged in a row are located on the upper side 122. The first tongue plate 12 has a plurality of slots 126 on a front end thereof. The insulative housing 1 has a plurality of recesses 13 and a receiving room 14 on a rear end relative to the first interface 10. The insulative housing 1 has a pair of notches 16 formed on two lateral sides of the receiving room 14 and a pair of depressions 17 formed on two lateral sides of the insulative housing 1.

Referring to FIGS. 2-5, the first contact group 3 comprises a plurality of first contacts 31 and a plurality of second contacts 32. Each first contact 31 comprises a first contacting portion 33, a first tail portion 35 for electrical connection to a printed circuit board (not shown), and a first connecting portion 34 for connecting the first contacting portion 33 and the first tail portion 35. The first contacting portion 33 has a convex section (not labeled) which makes the contacting portion 33 flexible. The first contacting portion 33 is received in the first grooves 123, the convex section extending beyond the lower side 121 and extending downwardly into the receiving chamber 15. The first connecting portion 34 extends from a rear end of the first contacting portion 33 and bends downwardly to be retained in the corresponding recess 13. An arrangement of the first contacts 31 is compatible to a standard USB connector. In detail, the first contacts 31 comprise a first power contact 311, a first ground contact 313 and a pair of first differential contacts 312 located between the first power contact 311 and the first ground contact 313. The first differential contacts 312 comprise a + data contact and a − data contact.

Each second contact 32 comprises a second contacting portion 36, a second tail portion 38 for electrical connection to the printed circuit board and a second connecting portion 37 for connecting the second contacting portion 36 and the second tail portion 38. The second connecting portion 37 extends backwardly from a front end of the second contacting portion 36 and bends downwardly. The second contacting portion 36 is stiff and is received in the corresponding second groove 124. Therefore the first contacting portion 33 and the second contacting portion 36 have different height along a thickness direction of the first tongue plate 12. In the other words, the convex section of the first contacting portion 33 extending downwardly beyond the second contacting portion 36. The second connecting portion 37 is entirely received in the corresponding third groove 125. The second contacts 32 comprise two pair of second differential contacts 321 and a second ground contact 322 located between the two pair of second differential contacts 321 for preventing cross-talk. Each pair of second differential contacts comprise a + data contact and − data contact.

Referring to FIG. 3-5, the first inner shell 5 is assembled in the receiving chamber 15 of the first interface 10. The first inner shell 5 has a plurality of legs 53 for coupling to the insulative housing 1. The first inner shell 5 has a plurality of spring tabs 51 formed on an upper surface, a lower surface and two lateral sides thereof to bias against an outer side of a mating plug.

Referring to FIGS. 4 and 5, the first spacer 7 is received in the receiving room 14 and has a pair of blocks 76 for engaging with the notches 16. The first spacer 7 has a plurality of holes 72 through which the second connecting portion 37 goes. The second inner shell 6 is the same as the first inner shell 5, and the second spacer 8 is the same as the first spacer 7. So, detailed description about the second inner shell 6 and the second spacer 8 are omitted here.

The outer shell 2 encloses the insulative housing 1 with a first opening 20 cooperating with the first interface 10 and a second opening 21 cooperating with the second interface 11. The outer shell 2 has a pair of retaining tabs 27 on two lateral sides to engage with the depressions 17 and a pair of latching barbs 22 to clasp a lower surface of the insulative housing 1. Thus, the outer shell 2 is secured on the insulative housing 1 firmly.

Figure 2:
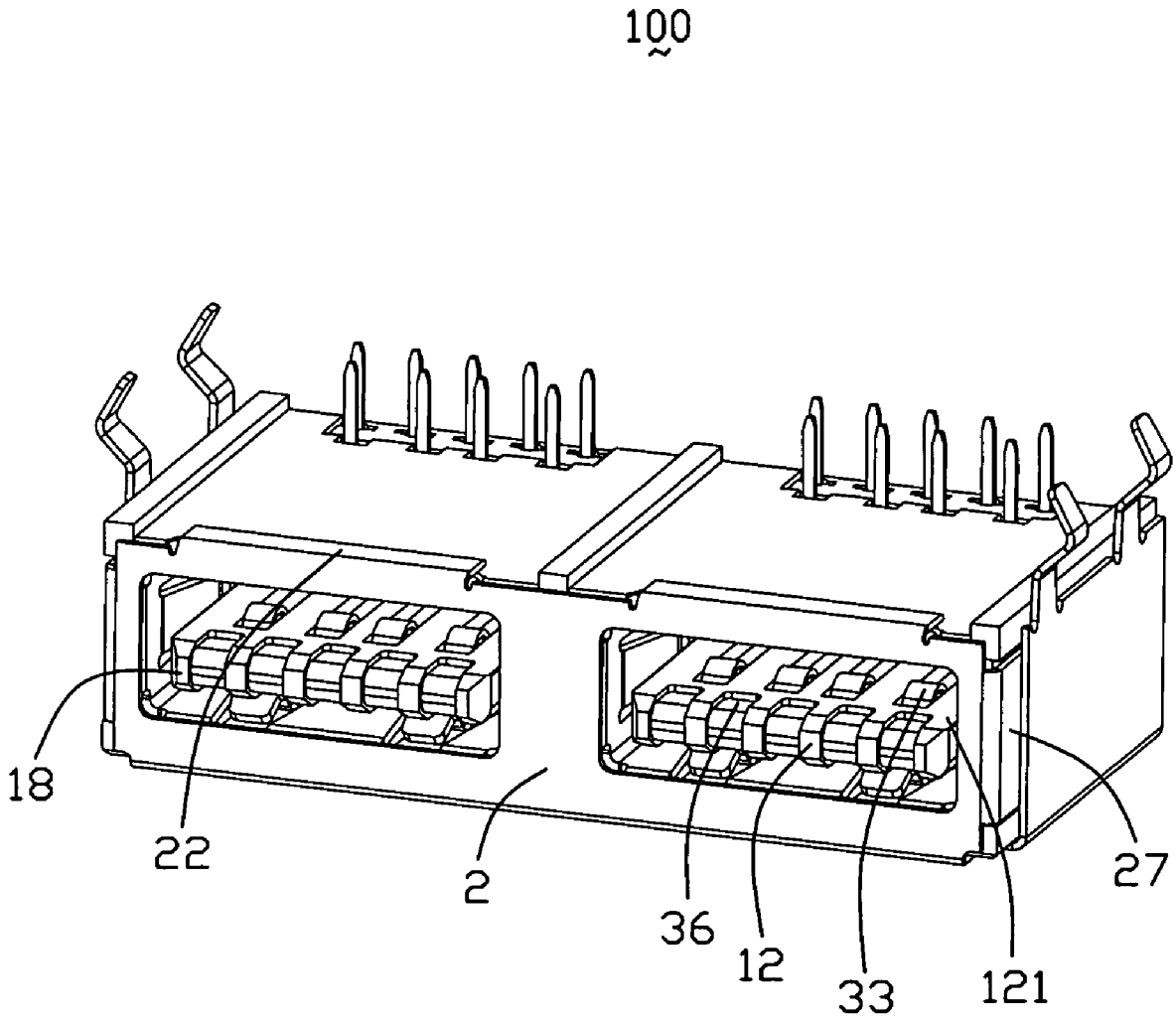
FIG. 2 is an another perspective view of the electrical connector shown in FIG. 1.
Figure 8:
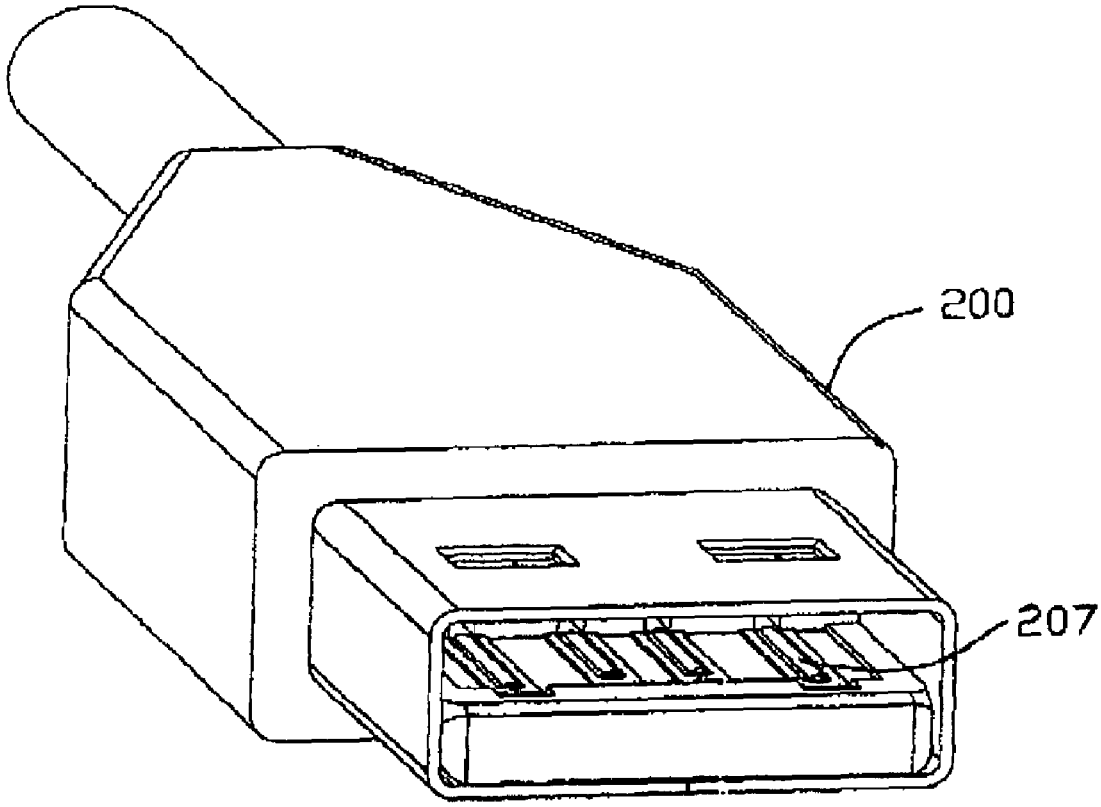
FIG. 8 (PRIOR ART)
FIG. 8 is a perspective schematic view of a standard USB plug.

Referring to FIGS. 2, 3 and 8, the electrical connector 100 is adapted for mating with a standard USB plug 200. The geometric profile of the first tongue plate 12 is the same to that of the standard USB connector (not shown) within an allowable tolerance, that is, length, width and height of the first tongue plate 12 are substantially equal to that of the standard USB connector. An arrangement of the first contacts 31 is compatible to a standard USB connector. This means that the electrical connector 100 can be applied in any field that the standard USB connector is applied. It is easy to be understood, the standard USB connector could be a standard A-type USB connector, a standard mini-A type USB connector, a standard mini-B type USB connector or a standard mini-AB type USB connector. When the standard USB plug 200 is inserted into the first interface 10 for mating with the first contacts 33, the second contacts 36 which is stiff and in front of the first contacts will not contact with stiff terminals 207 of the standard USB plug 200. When the first contacts 31 and the second contacts 32 mate with terminals of a corresponding plug (not shown) simultaneously, the second contacts 32 have two pair of second differential contacts 321 mating with the corresponding terminals to provide a high transfer data. The second contact group 4 and the second interface 11 are the same as the first contact group 3 and the first interface 10. So, the first interface 10 and the second interface 11 arranged side by side can mate with one more plugs and decrease the vertical size of the electrical connector 100. It is also easy to be understood that, an arrangement of the second contact group 3 could be adapted for other protocol such as SATA protocol, HDMI protocol or USB protocol etc, and the second interface 11 could be different with the first interface 10.

Figure 6:
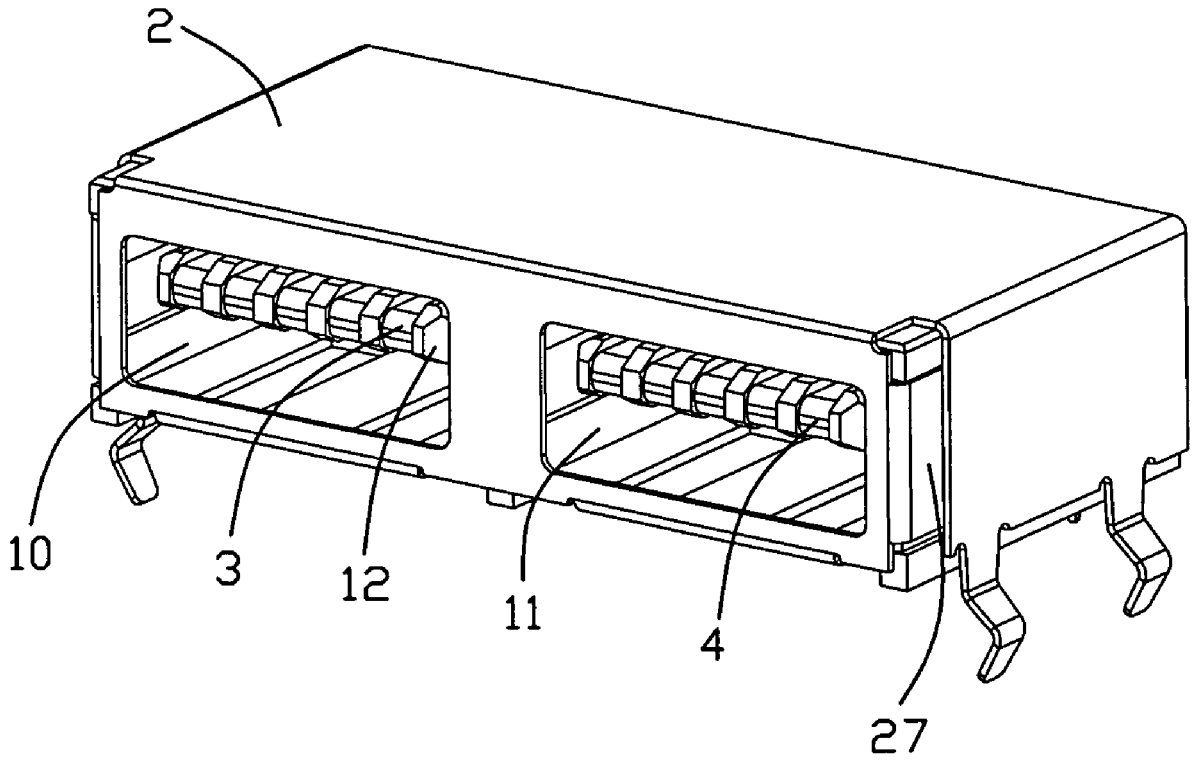
FIG. 6 is a perspective view of an electrical connector according to a second embodiment of the present invention.

Referring to FIG. 6, in a second embodiment of present invention, the electrical connector 100 can have no first inner shell 5 and second inner shell 6.

Figure 7:
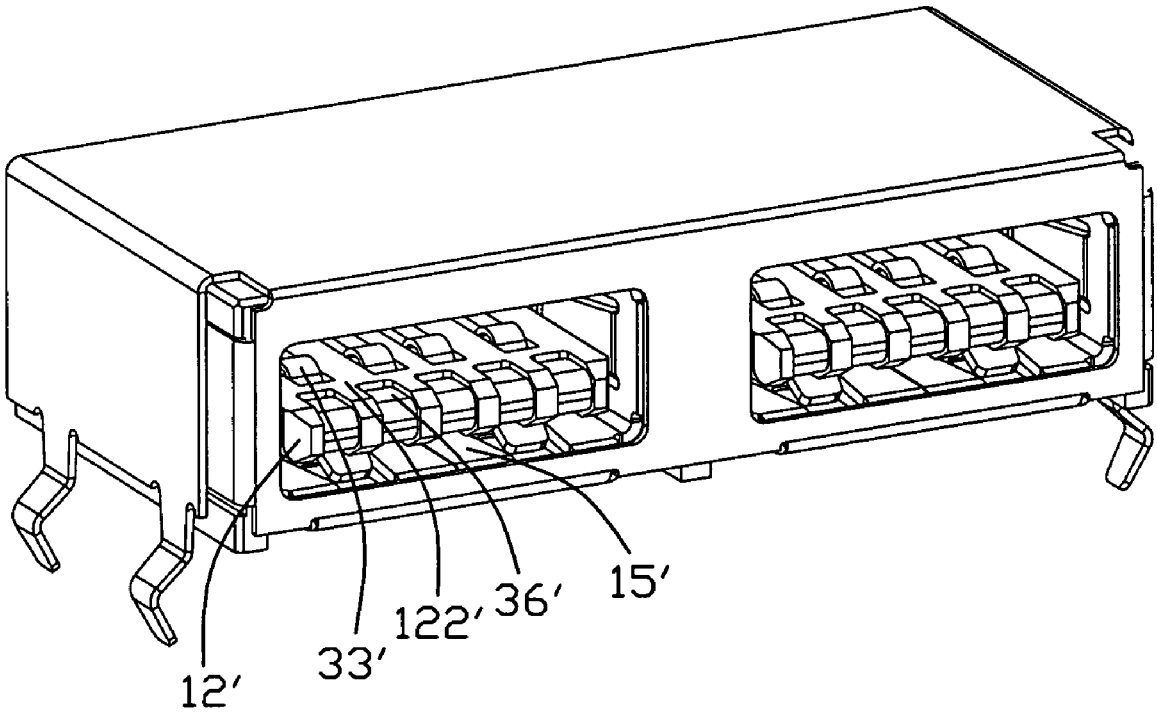
FIG. 7 is a perspective view of an electrical connector according to a third embodiment of the present invention.

In the first embodiment of the present invention, the first tongue plate 12 is received in a lower portion of the receiving chamber 15, the first contacting portions 33 and the second contacting portions 36 are located on the lower side 121 of the first tongue plate 12. Referring to FIG. 7, in a third embodiment of the present invention, the first tongue plate 12' could be received in an upper portion of the receiving chamber 15', the first contacting portions 33' and the second contacting portions 36' are located on the upper side 122' of the first tongue plate 12'.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

a first interface having a first tongue plate extending therein;

a second interface disposed on a lateral side of the first interface;

a first contact group held in the first tongue plate, the first contact group comprising a plurality of first contacts each having a first resilient contacting portion and a plurality of second contacts each having a second stiff contacting portion, the first contacting portion and the second contacting portion being essentially located on a same side of the first tongue plate; and a second contact group extending into the second interface, wherein the first contacting portions are located behind the second contacting portion, wherein the first tongue plate forms an upper side and a lower side opposite to the upper side, wherein the first contacting portions and the second contacting portions are essentially located on the upper side, wherein the first contacting portions and the second contacting portions are essentially located on the lower side, wherein the first contacts are adapted for mating with terminals of a standard USB plug, the first contacts comprise a first power contact, a first ground contact, and a pair of first differential contacts located between the power contact and the ground contact, wherein a geometric profile of the first tongue plate is substantially the same as that of a standard USB connector, wherein the second contacts comprise two pair of second differential contacts and a second ground contact located between the two pair of second differential contacts, wherein each first contact has a first tail portion for electrical connection to a printed circuit board and a first connecting portion connecting the first contacting portion and the first tail portion, the first connecting portion extends from a rear end of the contacting portion, each second contact has a second tail portion for electrical connection to the printed circuit board and a second connecting portion connecting the second contacting portion and the second tail portion, the second connecting portion extends backwardly from a front end of the second contacting portion and along another side of the first tongue plate, wherein the first interface has a receiving chamber accommodating the first tongue plate, the electrical connector comprises a first inner shell assembled in the receiving chamber, wherein the first interface and the second interface are integrally formed on an insulative housing.

2. An electrical connector comprising:

an insulative housing having a first interface and a second interface arranged side by side, the first interface having a first tongue plate extending therein;

a first contact group held in the insulative housing, the first contact group comprising a plurality of first contacts each having a first contacting portion and a plurality of second contacts each having a second contacting portion, the first contacting portions and the second contacting portions being essentially located on a same side of the first tongue plate and having a different height along a thickness direction of the first tongue plate; and a second contact group held in the insulative housing and extending into the second interface, wherein the first contacting portions are located behind the second contacting portions, wherein each first contacting portion has a convex section to be flexible, each second contacting portion is stiff, wherein an arrangement of the first contacts is compatible to a standard USB connector, the first contacts comprise a first power contact, a first ground contact, and a pair of first differential contacts located between the power contact and the ground contact, wherein each first contact has a first tail portion for electrical connection to a printed circuit board and a first connecting portion connecting the first portion and the first tail portion, the first connecting portion extends from a rear end of the first contacting portion and is assembled into the insulative housing, each second contact has a second tail portion for electrical connection to the printed circuit board and a second connecting portion connecting the second portion and the second tail portion, the second connecting portion extends backwardly from a front end of the second contacting portion and along another side of the first tongue plate under condition that the second connecting portion is assembled into the insulative housing, wherein the first interface has a receiving chamber accommodating the first tongue plate, the electrical connector comprises a first inner shell assembled in the receiving chamber.

* * * * *